US010174936B2

(12) United States Patent
Liu et al.

(10) Patent No.: US 10,174,936 B2
(45) Date of Patent: Jan. 8, 2019

(54) CIRCULAR FLUIDIZING BED COMBUSTION SYSTEM WITH UNIFORM AIRFLOW DISTRIBUTING DEVICE

(71) Applicant: GUANGDONG UNIVERSITY OF TECHNOLOGY, Guangzhou (CN)

(72) Inventors: Xiaozhou Liu, Guangzhou (CN); Yu Zhang, Guangzhou (CN); Wenxing Liu, Guangzhou (CN)

(73) Assignee: Guangdong University of Technology, Guangzhou, GD (CN)

( * ) Notice: Subject to any disclaimer, the term of this patent is extended or adjusted under 35 U.S.C. 154(b) by 0 days.

(21) Appl. No.: 15/563,456

(22) PCT Filed: Oct. 29, 2016

(86) PCT No.: PCT/CN2016/103862
§ 371 (c)(1),
(2) Date: Sep. 29, 2017

(87) PCT Pub. No.: WO2017/206430
PCT Pub. Date: Dec. 7, 2017

(65) Prior Publication Data

US 2018/0195714 A1 Jul. 12, 2018

(30) Foreign Application Priority Data

May 30, 2016 (CN) ..... 2016 1 0373491

(51) Int. Cl.
*F23C 10/12* (2006.01)
*F23C 10/18* (2006.01)
(Continued)

(52) U.S. Cl.
CPC ..... *F23C 10/12* (2013.01); *F23C 7/008* (2013.01); *F23C 10/02* (2013.01); *F23C 10/20* (2013.01);
(Continued)

(58) Field of Classification Search
CPC ..... F23C 10/12; F23C 10/18; F23C 10/20; F23C 10/02; F23C 7/008; F23C 7/00; F23C 7/0022; F23J 15/022; F26B 3/082
(Continued)

(56) References Cited

U.S. PATENT DOCUMENTS 3,921,663 A * 11/1975 Beranek ..... B01J 8/1818 137/533.11
4,240,364 A * 12/1980 Bryers ..... B01J 8/1872 110/245
(Continued)

FOREIGN PATENT DOCUMENTS

CN 2419490 Y 2/2001
CN 101576254 A 11/2009
(Continued)

OTHER PUBLICATIONS

International Search Report for Application No. PCT/CN2016/103862 in Chinese (5 pgs.).

*Primary Examiner* — Huy Tram Nguyen
(74) *Attorney, Agent, or Firm* — Patterson Thuente Pedersen, P.A.

(57) ABSTRACT

A circular fluidizing bed combustion system with uniform airflow distributing device is provided. The system comprises a fluidizing bed and a uniform airflow distributing device. The fluidizing bed is comprised of a fluidizing bed boiler body, an airflow distributing plate and a plurality of air caps, wherein, the airflow distributing plate is provided inside the fluidizing bed boiler body and divides the inner space of the fluidizing bed boiler body into a fluidizing chamber which is located in the upper portion of the boiler body and an air chamber which is located in the lower portion of the boiler body, and the plurality of air caps are arranged on the airflow distributing plate for injecting the fluidizing air into the fluidizing chamber. The inner space of
(Continued)

the air chamber is divided into a distributing chamber that is located under the airflow distributing plate and an air inlet chamber that is located on one side of the distributing chamber by means of a perforated plate. The distributing chamber is comprised of a front wall, two side walls, a top wall that extends upwards obliquely from the upside of the front wall, and a bottom wall extends downwards obliquely from the downside of the front wall. A first guide plate, a second guide plate and a third guide plate are installed in the distributing chamber. This system makes the flow of the fluidizing air entered into the fluidizing chamber through each air cap uniform, and enhances the combusting efficiency of the coal powder in the fluidizing chamber.

10 Claims, 4 Drawing Sheets

(51) Int. Cl.

| | |
|---|---|
| ***F23C 10/20*** | (2006.01) |
| ***F23C 7/00*** | (2006.01) |
| ***F23C 10/02*** | (2006.01) |
| ***F26B 3/08*** | (2006.01) |
| ***F23J 15/02*** | (2006.01) |
| *F23C 10/24* | (2006.01) |
| *F23G 5/30* | (2006.01) |
| *F23J 3/02* | (2006.01) |

(52) U.S. Cl.
CPC ..... *F23J 15/022* (2013.01); *F26B 3/082* (2013.01); *F23C 10/24* (2013.01); *F23G 5/30* (2013.01); *F23J 3/02* (2013.01)

(58) Field of Classification Search
USPC ..... 422/139
See application file for complete search history.

(56) References Cited

U.S. PATENT DOCUMENTS

| | | | | |
|---|---|---|---|---|
| 4,446,629 | A * | 5/1984 | Stewart | B01J 8/1827 122/4 D |
| 4,521,976 | A * | 6/1985 | Stewart | B01J 8/1827 34/368 |
| 5,101,576 | A | 4/1992 | Abdulally | |

FOREIGN PATENT DOCUMENTS

| | | | |
|---|---|---|---|
| CN | 101881440 | A | 11/2010 |
| CN | 202253613 | U | 5/2012 |
| CN | 204084342 | U | 1/2015 |
| CN | 204574016 | U | 8/2015 |
| CN | 105927970 | A | 9/2016 |
| CN | 205807394 | U | 12/2016 |
| SU | 1312313 | A1 | 5/1987 |

* cited by examiner

CIRCULAR FLUIDIZING BED COMBUSTION SYSTEM WITH UNIFORM AIRFLOW DISTRIBUTING DEVICE

RELATED APPLICATIONS

The present application is a National Phase entry of PCT Application No. PCT/CN2016/103862, filed Oct. 29, 2016, which claims priority to CN 2016103734913, filed May 30, 2016, all said applications being hereby incorporated herein by reference in their entireties.

TECHNICAL FIELD

The present invention relates to a circular fluidizing bed, and more particularly to an airflow distributing system of circular fluidizing bed.

BACKGROUND

The circular fluidizing bed boiler with unique hydrodynamic characteristics and structure has advantages such as wide fuel adaptability, high combustion efficiency, efficient desulfurization, low nitrogen oxide emission, large load regulating range etc. However, most fluidizing beds subject to non-uniform airflow distribution, resulting in high power and energy consumption. One of the measures to change such poor situation is adopting reasonable design to improve the airflow distribution system.

The airflow distribution system is one of the core systems of circular fluidizing bed boiler, and therefore airflow distribution uniformity is the essential factor to ensure the normal operation of the whole system. Inferior airflow distribution may affect the boiler's general combustion condition adversely, even cause failure of fluidizing beds combustion. Therefore, it is of vital importance to maintain a reasonable and uniform airflow distribution, in order to ensure normal fluidization, stable combustion and safe operation of the circular fluidizing bed boiler.

An airflow distributing plate central airflow distributing device for circular fluidizing bed boiler and the methods thereof is disclosed in China Patent Application No. 201410819148.8. The device described in the invention comprises a primary hot air duct that is connected to an under-bed start-up burner. The under-bed start-up burner is connected to a water cooling air chamber. The water cooling air chamber is connected to an airflow distributing plate and the airflow distributing plate is connected to a furnace. However, the airflow distributing plate central airflow distributing device and the airflow distributing method of the circular fluidizing bed boiler disclosed in this patent is difficult to implement in practice, and therefore fails to realize the effect of uniform airflow distribution.

A fluidizing bed airflow distributing system is disclosed in China Patent No. 201520167916.6. The system comprises two air chambers that are provided on two sides of a furnace in parallel and supplied with airflow from a main air supply duct. Several air ducts are welded between the two air chambers to form air supply channel. The two air chambers supply the air ducts with airflow. Several duct heads are provided on each air duct and an air cap is provided on each duct head to form primary air bed. However, the fluidizing bed airflow distributing system described in this patent fails to achieve uniform airflow distribution.

Therefore, a circular fluidizing bed uniform airflow distributing system is urgently required in the art.

SUMMARY

The object of the present invention is to provide a circular fluidizing bed combustion system with uniform airflow distributing device, which is capable of achieving the goals of distributing the fluidizing air into the fluidizing bed uniformly and enhancing combustion efficiency considerably.

To achieve the above mentioned purposes, a circular fluidizing bed combustion system with uniform airflow distributing device is provided in this invention, comprising a fluidizing bed and a flue gas channel. The fluidizing bed is comprised of a fluidizing bed boiler body, an airflow distributing plate that is provided inside the fluidizing bed boiler body and divides the inner portion of the fluidizing bed boiler body into a fluidizing chamber which is located in the upper portion of the boiler body and an air chamber that is located in the lower portion of the boiler body, and many air caps that arranged on the airflow distributing plate for injecting the fluidizing air into the fluidizing chamber. The flue gas channel is connected to the sidewall of the fluidizing bed boiler body, in order to exhaust the flue gas generated from the fuel combustion in the fluidizing chamber. The inner space of the air chamber is divided into a distributing chamber that is located under the airflow distributing plate and an air inlet chamber that is located on one side of the distributing chamber by means of a perforated plate. The distributing chamber is comprised of a front wall, two side walls, and a top wall that extends upwards obliquely from the upside of the front wall, and a bottom wall that extends downwards obliquely from the downside of the front wall. A vertical distance H is defined between a first planar surface that passes through the extension end of the top wall and parallel with the airflow distributing plate and a second planar surface that passes through the extension end of the bottom wall and parallel with the airflow distributing plate. The perforated plate lies in the surface that passes through the extension end of both top wall and bottom wall and perpendicular with the first and second planar surfaces. A horizontal distance W is defined between the front wall of the distributing chamber and the perforated plate. At least a first guide plate and a second guide plate are installed in the distributing chamber, with two side edges of the first guide plate and the second guide plate fixed to two side walls of the distributing chamber respectively. The vertical distance between the bottom edge of the first guide plate and the first planar surface is 0.3-0.4 H, the horizontal distance between the bottom edge of the first guide plate and the perforated plate is 0.2-0.3 W, and the first guide plate extends upwards and forwards by a distance of 0.1-0.2 H at an angle of 70-80 degree from the bottom edge with respect to the second planar surface. The vertical distance between the bottom edge of the second guide plate and the first planar surface is 0.4-0.5 H, the horizontal distance between the bottom edge of the second guide plate and the perforated plate is 0.4-0.6 W, and the second guide plate extends upwards and forwards by a distance of 0.13-0.18 H at an angle of 75-85 degree from the bottom edge with respect to the second planar surface, wherein W:H is set to 1-1.5:1.

Wherein, the uniform airflow distributing device described herein is a device that comprises the air chamber and the internal parts thereof, the airflow distributing plate and the air cap, as well as the associated connecting piping.

Preferably, a third guide plate is further installed in the distributing chamber. The third guide plate is comprised of a straight guide plate and an arched guide plate that extends downwards and backwards from the bottom edge of the straight guide plate. The vertical distance between the bottom edge of the straight guide plate and the first planar surface is 0.6-0.7 H, and the horizontal distance between the bottom edge of the straight guide plate and the perforated plate is 0.7-0.8 W. The straight guide plate extends upwards and forwards by a distance of 0.15-0.2 H at an angle of 70-80 degree from the bottom edge with respect to the second planar surface. The arched guide plate is with a central angle of 80-100 degree and a radius of 0.05-0.1 H. More preferably, the straight guide plate is tangent to the arched guide plate.

Optionally, several rows of rectangular holes are formed on the perforated plate from one side edge to the other along longitudinal direction, with each row of the rectangular holes comprised of several rectangular holes that are arranged sequentially from the upper edge to the lower edge of the perforated plate along vertical direction.

Optionally, the long side of each rectangular hole is provided along the longitudinal direction of the perforated plate, the short side of each rectangular hole is provided along the vertical direction of the perforated plate, and the length-width ratio for each rectangular hole is set to 3-5:1. Several rows of rectangular holes are symmetrically arranged with respect to the vertical central line of the perforated plate.

Optionally, two adjacent rows of rectangular holes of the perforated plate which situate on the same side with respect to the vertical central line are staggered in vertical direction, each row of the rectangular holes comprised of at least 8 rectangular holes. A row of central holes are provided from the upper edge to the lower edge on the perforated plate along the vertical central line, the row of central holes are comprised of at least 8 central holes, and each central hole is a circular or square hole.

Optionally, the air inlet chamber of the air chamber is comprised of a top wall, a bottom wall, a back wall and two side walls. The top wall of the air inlet chamber is connected to the top wall of the distributing chamber, the bottom wall of the air inlet chamber is connected to the bottom wall of the distributing chamber, and the two side walls of the air inlet chamber are connected to the two side walls of the distributing chamber respectively. The back wall of the air inlet chamber and the front wall of the distributing chamber are provided opposing to each other in longitudinal direction of the air chamber. An air inlet port is provided on the top wall of the air inlet chamber adjacent to the back wall, an airflow shield is formed by the forward extension of the lower portion of the back wall. The bottom edge of the airflow shield is connected to the bottom wall.

Optionally, the front end of the top wall of the air inlet chamber is formed into an upper transitional plate that extends upwards obliquely and the extension end thereof is connected to the top wall of the distributing chamber. The front end of the bottom wall of the air inlet chamber is formed into a lower transitional plate that extends downwards obliquely and the extension end thereof is connected to the bottom wall of the distributing chamber.

Optionally, an airflow guiding device is provided on the bottom wall of the air inlet chamber. The airflow guiding device comprises a first airflow guiding surface and a second airflow guiding surface. The bottom edge of the first airflow guiding surface is connected to the bottom wall and the first airflow guiding surface extends upwards and backwards from the bottom edge. The bottom edge of the second airflow guiding surface is connected to the bottom wall and the second airflow guiding surface extends upwards and forwards from the bottom edge. The top edge of the first airflow guiding surface is connected to the top edge of the second airflow guiding surface.

Preferably, the second air guiding surface is an arc surface that extends upwards and forwards from the bottom edge, the chord of the arc surface is inclined with respect to the bottom wall of the air inlet chamber at an angle of 30-50 degree. The vertical distance between the top edge of the first airflow guiding surface and the bottom wall of the air inlet chamber is 0.2-0.3 H, and the horizontal distance between the top edge of the first airflow guiding surface and the bottom edge of the first airflow guiding surface is 0.4-0.6 H, and the horizontal distance between the top edge of the second airflow guiding surface and the bottom edge of the second airflow guiding surface is 0.2-0.3 H.

Optionally, the second airflow guiding surface is planar surface.

Optionally, the extension end of the top wall of the distributing chamber is connected to the upper edge of the perforated plate directly, and the extension end of the bottom wall of the distributing chamber is connected to the lower edge of the perforated plate directly.

Optionally, an upper water collecting pipe is arranged at the top connection area of the distributing chamber and the air inlet chamber of the air chamber, and a lower water collecting pipe is arranged at the bottom connection area of the distributing chamber and the air inlet chamber. Two first clamping plates which are used to nest the upper edge of the perforated plate extend downwards along the pipe wall of the upper water collecting pipe, and two second clamping plates which are used to nest the lower edge of the perforated plate extend upwards along the pipe wall of the lower water collecting pipe.

Wherein the upper water collecting pipe and the lower water collecting pipe are a portion of the water supply piping of the water cooled wall system of the fluidizing bed, the cooled water in which is used to avoid the overheating damage to the first and second clamping plates that are used for nesting the perforated plate.

Optionally, several air outlet ports are arranged on the top wall of the distributing chamber in array, with each air outlet port connecting to each air cap of the airflow distributing plate through air inlet duct, in order to direct the air from the distributing chamber into the fluidizing bed through the air inlet duct. Each air cap is comprised of an inner duct, an outer duct that nested out the inner duct, and at least two air outlet ducts that are spaced extending downwards from the side wall of the outer duct and connecting to the internal portion of the outer duct. The inner duct extends upwards from the upper surface of the airflow distributing plate about each air inlet duct on the airflow distributing plate. The downside of the outer duct is connected to the upper surface of the airflow distributing plate, the upside of the outer duct is closed and the upper wall thereof is located above the upside of the inner duct. Wherein at least six air holes are arranged on the duct wall of the outer duct below the at least two air outlet ducts, so that after the fluidizing air from the air chamber has passed the upside of the inner duct into the space between the outer wall of the inner duct and the inner wall of the outer wall through the air inlet port, a portion of the fluidizing air is injected to the upper surface of the airflow distributing plate through the at least two air outlet ducts, and the other portion of the fluidizing air is injected into the fluidizing bed through the at least six air holes.

Optionally, several air outlet ports that arranged on the top wall of the distributing chamber in array are of the same size.

Optionally, the distance between the terminal end of the air outlet duct and the upper surface of the airflow distributing plate is one sixth to one third of the whole length of the inner duct. The distance between the upside of the inner duct and the top wall of the outer duct is one tenth to one fifth of the entire length of the inner duct. The diameter of the outer duct is two to five times as much as that of the inner duct.

Optionally, 2-4 air outlet ducts with equal length are provided equally spaced about the side wall of the outer duct, the diameter of the circumference in which the terminal end of the air outlet duct is two to five times as much as the diameter of the outer duct.

Optionally, the angle between the central axis of the air outlet duct and the inner duct is set to 30-60 degree, preferably 40-50 degree, such as 45 degree.

Optionally, the bottom portion of the inner duct and the outer duct are fixedly connected to the upper surface of the airflow distributing plate by welding, riveting, threading or other means.

Optionally, the circular fluidizing bed combustion system with uniform airflow distributing device further comprises a flue gas separation device and a heat pipe heat exchanger arranged along the flow direction of flue gas in the flue gas channel.

The flue gas separation device comprises a separator body, a high temperature flue gas inlet, a lower exhaust tube, and a feedback outlet. Wherein, the high temperature flue gas inlet is provided on the side wall of the separator body and connected to the flue gas channel. The lower exhaust tube is perpendicular to the inner cavity of the separator body, of which the top inlet is provided far away from the top wall of the separator body and the bottom outlet is connected to the heat tube heat exchanger through the flue gas channel. The feedback outlet is provided on the bottom of the separator body and connected to the fluidizing chamber through a feedback pipe.

Optionally, the bottom portion of the separator body is provided with a tapered portion, and the feedback outlet is formed on the side wall of the tapered portion.

Wherein the heat pipe heat exchanger comprises a housing, a middle partition and several heat pipes that are arranged through the middle partition. The middle partition divides the inner space of the housing into a flue gas flow path and an air flow path that are parallel with each other in reverse. The evaporating end of the heat pipe extends in the flue gas flow path, and the condensing end of the heat pipe extends in the air flow path. The two ends of the flue gas flow path are formed into a cleaning flue gas inlet and a low temperature flue gas outlet, and the two ends of the air flow path are formed into a cold air inlet and a hot air outlet. The cleaning flue gas inlet is connected to the bottom outlet of the lower exhaust tube through the flue gas channel, to direct the high temperature flue gas into the flue gas flow path, in order to heat the cold air in the fluid flow path into hot air. The low temperature flue gas outlet is connected to a chimney through the flue gas channel. The cold air inlet is connected to a first fan through a cold air piping, and the hot air outlet is connected to the air chamber through a hot air pipe.

Optionally, the flue gas channel branches into a back-flow flue gas pipe between the flue gas separation device and the heat pipe heat exchanger. The back-flow flue gas pipe is connected to the hot air pipe and a mixer is provide at the connection area thereof to mix a portion of the hot flue gas from the flue gas separation device and the hot air from the heat pipe heat exchanger into gas mixtures.

Optionally, the back-flow flue gas pipe returns 10-20%, preferably 15% of the flue gas to the mixer in order to mix it with the hot air.

Wherein the hot flue gas in the back-flow flue gas pipe with a temperature of about 800° C. and an oxygen content of about 5% is mixed with the hot air in the hot air pipe with a temperature of about 200° C. and an oxygen content of about 21% in the mixer to form gas mixtures with a temperature of about 500□ and a oxygen content of about 13%.

Optionally, the mixer comprises a mixer body, a hot air inlet that is provided at one end of the mixer body, a hot flue gas inlet that is provided at one side of the mixer body, a gas mixing cavity that is provided in the inner space of the mixer body, and a gas mixtures outlet that is provided at the other end of the mixer body. The hot air inlet of the mixer is connected to the hot air outlet of the heat pipe heat exchanger through the hot air pipe, the hot flue gas inlet of the mixer is connected to the back-flow flue gas pipe, and the gas mixtures outlet of the mixer is connected to the air inlet port of the air inlet chamber of the air chamber through a gas mixtures pipe. Rotating impellers are provided in the gas mixing cavity adjacent to the gas mixtures outlet.

Optionally, the hot temperature flue gas inlet of the flue gas separation device is provided on the side wall of the separator body in tangential direction.

Optionally, the circular fluidizing bed combustion system with uniform airflow distributing device further comprises a screw feeder that is connected to the coal powder inlet provided on the side wall of the fluidizing chamber, in order to deliver the coal powder into the fluidizing chamber for fluidizing combustion.

Optionally, a first valve is provided on the back-flow flue gas pipe adjacent to the mixer for adjusting the flow of the back-flow flue gas. A second valve is provided on the hot air pipe adjacent to the mixer for adjusting the flow of the hot air.

Optionally, the first and/or second valve could be pneumatic valve, solenoid valve, manual valve or other valve that is able to control the flow.

Preferably, a second fan is provided between the mixer and the air chamber, in order to deliver gas mixtures into the air chamber.

The beneficial technical effects of the invention are presented as follows: (1) an airflow guiding device is provided on the bottom wall of the air inlet chamber, to prevent the accumulation of the fluidizing airflow entered in the air inlet chamber at the bottom portion of air inlet chamber causing the non-uniform distribution of the fluidizing air in the distributing chamber; (2) a perforated plate is arranged between the air inlet chamber and the distributing chamber, of which the rectangular holes that formed on the two sides are relative bigger, and the central holes that formed in the middle are relative smaller, in order to prevent the gas from flowing through the middle portion too fast causing too much fluidizing airflow entering into the distributing chamber through the middle portion of the perforated plate; (3) a first guide plate, a second guide plate and a third guide plate are provided in the distributing chamber, many air outlet ports with the same size are arranged on the top wall of the distributing chamber in array, in order to make the flow of the fluidizing air entered into the fluidizing chamber through each air cap uniform, enhancing the combusting efficiency of the coal powder in the fluidizing chamber; (4) the structure of the air cap which make the air blow downwards is not only capable of making the fluidization reaction more uniform, but also preventing the bed material leaking into the air chamber through the air cap.

DETAILED DESCRIPTION OF THE DRAWINGS

Figure 1:
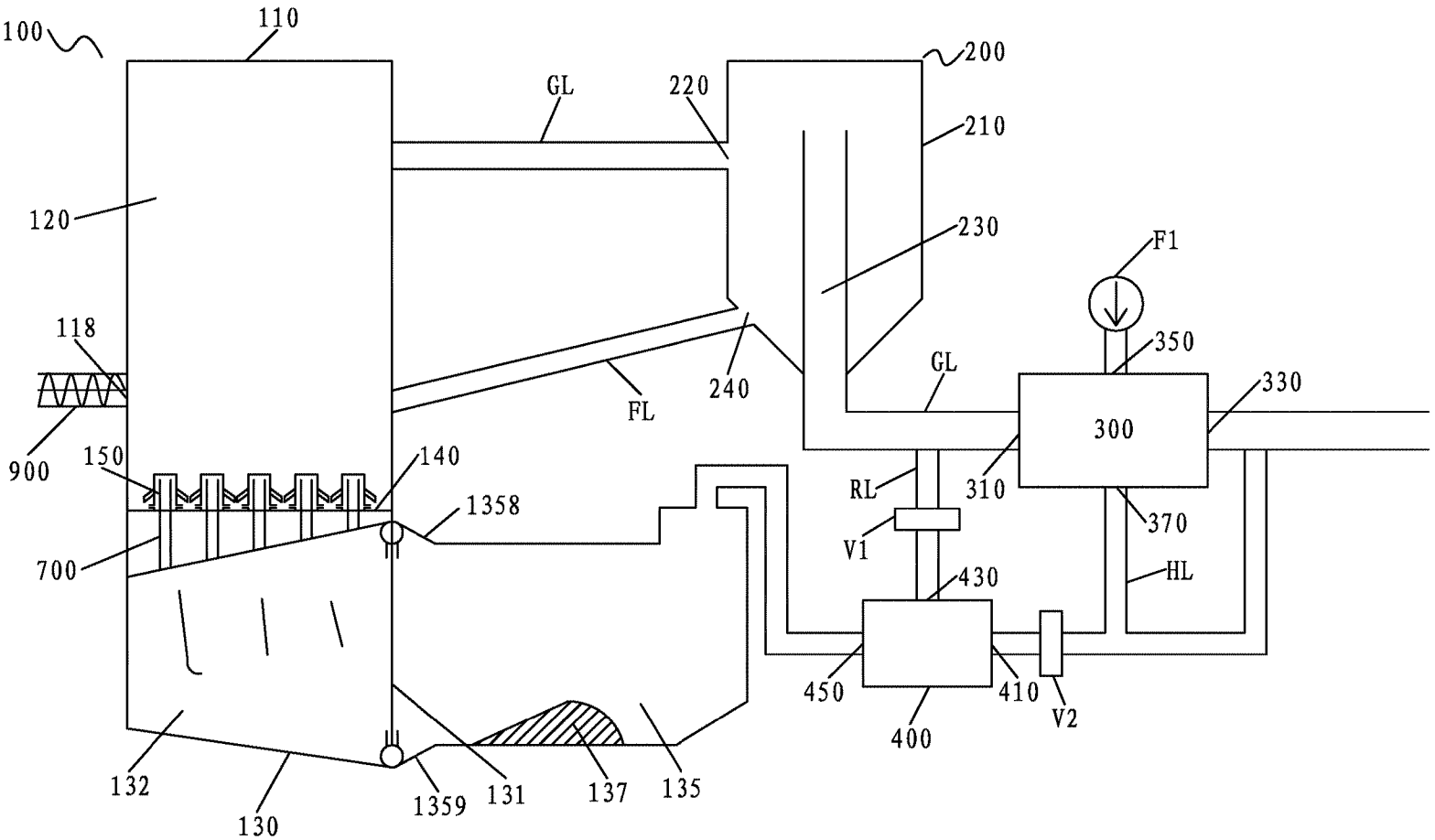
FIG. 1 is a structural illustration of a circular fluidizing bed combustion system with uniform airflow distributing device according to the present invention.

Now refer to FIG. 1, according to one unlimited embodiment of the present invention, a circular fluidizing bed combustion system with uniform airflow distributing device comprises a fluidizing bed 100 and a flue gas channel GL.

The fluidizing bed 100 is comprised of a fluidizing bed boiler body 110, an airflow distributing plate 140 and many air caps 150 that arranged on the airflow distributing plate 140 for injecting the fluidizing air into the fluidizing chamber 120. The airflow distributing plate 140 is provided inside of the fluidizing bed boiler body 110 and divides the internal space of the fluidizing bed boiler body 110 into a fluidizing chamber 120 which is located in the upper portion of the boiler body and an air chamber 130 that is located in the lower portion of the boiler body. The flue gas channel GL is connected to the sidewall of the fluidizing bed boiler body 110 to exhaust the flue gas generated in the fluidizing chamber 120.

Figure 2:
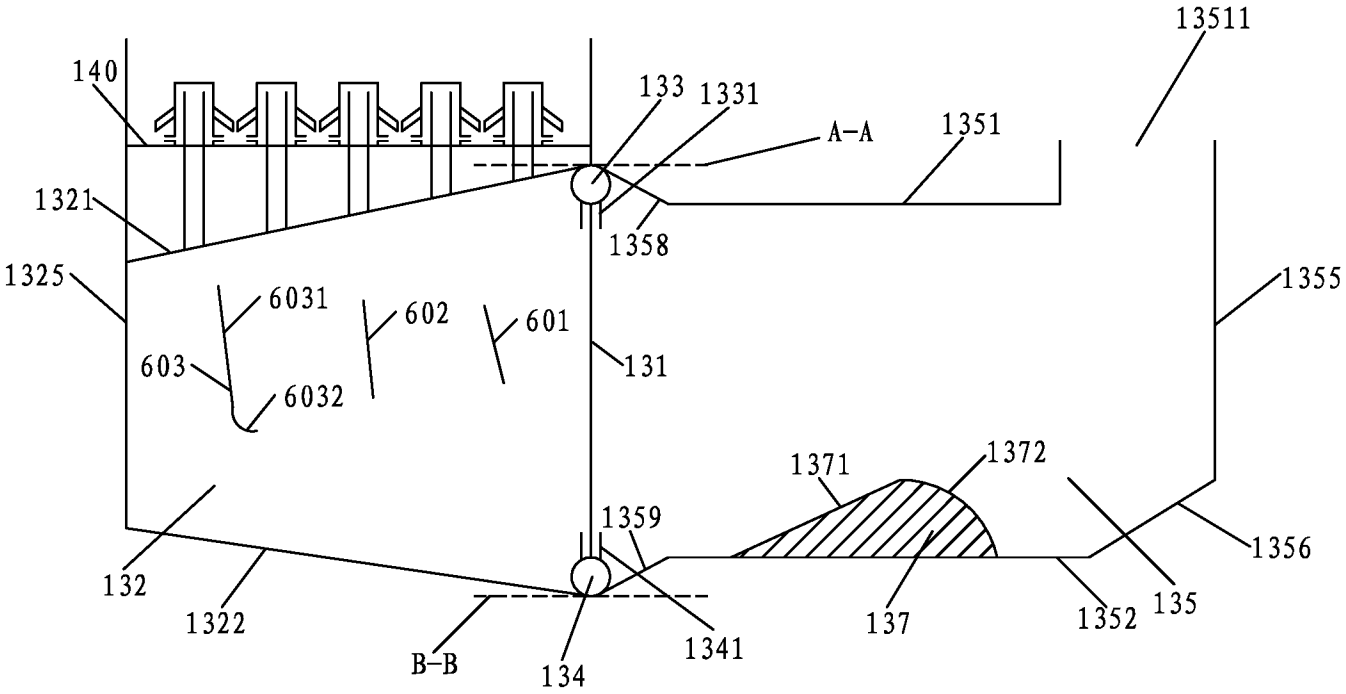
FIG. 2 is an internal structural illustration of the air chamber according to the present invention.

As shown in FIG. 2, the inner space of the air chamber 130 is divided into a distributing chamber 132 that is located under the airflow distributing plate 140 and an air inlet chamber 135 that is located on one side of the distributing chamber 132. The distributing chamber 132 is comprised of a front wall 1325, two side walls (not shown), a top wall 1321 that extends upwards obliquely from the upside of the front wall 1325, and a bottom wall 1322 that extends downwards obliquely from the downside of the front wall 1325. The extension end of the top wall 1321 is connected to the upper edge of the perforated plate (not shown), and the extension end of the bottom wall 1322 is connected to the lower edge of the perforated plate 131 (not shown), a vertical distance H is defined between a first planar surface (A-A planar surface) that passes through the extension end of the top wall 1321 and is parallel with the airflow distributing plate 140 and a second planar surface (B-B planar surface) that passes through the extension end of the bottom wall 1322 and is parallel with the airflow distributing plate 140. The perforated plate 131 lies in the surface that passes through the extension ends of both the top wall 1321 and the bottom wall 1322 and is perpendicular with planar surfaces A and B. The horizontal distance between the front wall 1325 of the distributing chamber 132 and the perforated plate 131 is indicated by W, wherein W:H is set to 4:3. A first guide plate 601, a second guide plate 602 and a third guide plate 603 are installed in the distributing chamber 132, with the two side edges of the first guide plate 601, the second guide plate 602 and the third guide plate 603 are fixed to the two side walls of the distributing chamber 132 respectively. The vertical distance between the bottom edge of the first guide plate 601 and the A-A planar surface is 0.31 H, the horizontal distance between the bottom edge of the first guide plate 601 and the perforated plate is 0.24 W, and the first guide plate 601 extends upwards and forwards 0.14 H at an angle of 78 degree from the bottom edge with respect to the B-B planar surface. The vertical distance between the bottom edge of the second guide plate 602 and planar surface A is 0.41 H, the horizontal distance between the bottom edge of the second guide plate 602 and the perforated plate is 0.5 W, and the second guide plate 602 extends upwards and forwards 0.16 H at an angle of 80 degree from the bottom edge with respect to planar surface B. The third guide plate 603 is comprised of a straight guide plate 6031 and an arched guide plate 6032 that extends downwards and backwards from the bottom edge of the straight guide plate 6031. The vertical distance between the bottom edge of the straight guide plate 6031 and planar surface A is 0.6 H, the horizontal distance between the bottom edge of the straight guide plate 6031 and the perforated plate 131 is 0.73 W, and the straight guide plate 6031 extends upwards and forwards 0.173 H at an angle of 76 degree from the bottom edge with respect to planar surface B. The arched guide plate 6032 is a circular arc with a central angle of 90 degree and a radius of 0.063 H.

The air inlet chamber 135 of the air chamber 130 is comprised of a top wall 1351, a bottom wall 1352, a back wall 1355 and two side walls (not shown). The top wall 1351 of the air inlet chamber 135 is connected to the top wall 1321 of the distributing chamber 132, and the bottom wall 1352 of the air inlet chamber 135 is connected to the bottom wall 1322 of the distributing chamber 132, the two side walls of the air inlet chamber 135 are connected to the two side walls of the distributing chamber 132 respectively. The back wall 1355 of the air inlet chamber 135 and the front wall 1325 of the distributing chamber 132 are provided opposing to each other in longitudinal direction of the air chamber 130. An air inlet port 13511 is provided on the top wall 1351 of the air inlet chamber 135 adjacent to the back wall 1355, an airflow shield 1356 is formed by the forward extension of the lower portion of the back wall 1355. The bottom edge of the airflow shield 1356 is connected to the bottom wall 1352.

In this unlimited embodiment, the front end of the top wall 1351 of the air inlet chamber 135 is formed into an upper transitional plate 1358, which extends upwards obliquely and the extension end thereof is connected to the top wall 1321 of the distributing chamber 132. The front end of the bottom wall 1352 of the air inlet chamber 135 is formed into a lower transitional plate 1359, which extends downwards obliquely and the extension end thereof is connected to the bottom wall 1322 of the distributing chamber 132.

Figure 3:
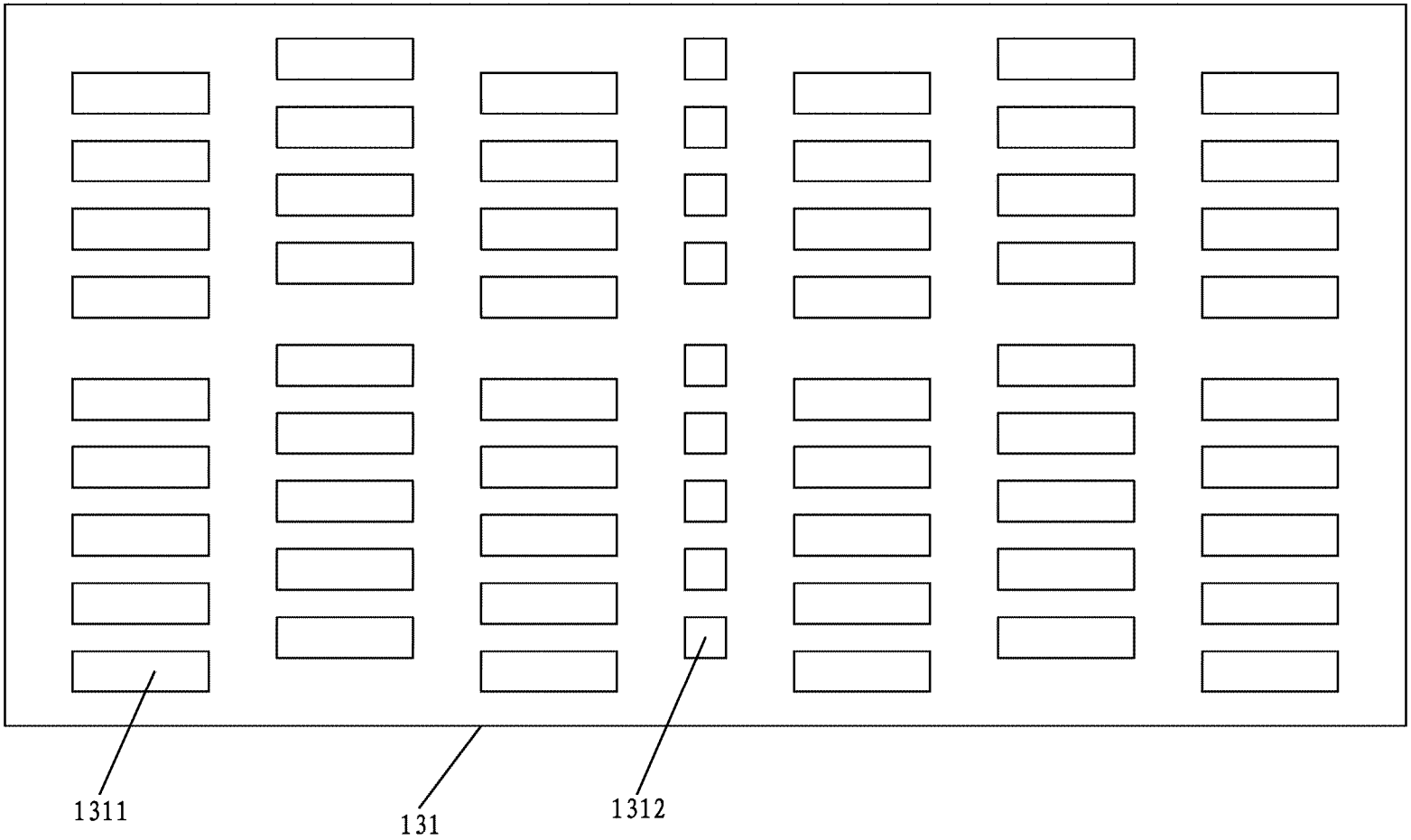
FIG. 3 is a structural illustration of a perforated plate according to the present invention.

As shown is FIG. 3, the perforated plate 131 is comprised of 6 rows of rectangular holes, which are arranged symmetrically with respect to the vertical central line on the perforated plate 131 from one side edge to the other, each row of the rectangular holes comprised of 9 rectangular holes 1311 which are arranged sequentially from the upper edge to the lower edge of the perforated plate 131 along the vertical direction. The long side of each rectangular hole 1311 is provided along the longitudinal direction of the perforated plate 131, the short side of each rectangular hole 1311 is provided in the vertical direction along the perforated plate 131, and the length-width ratio for each rectangular hole 1311 is set to 4:1. Two adjacent rows of rectangular holes on the perforated plate 131 which situated on the same side with respect to the vertical central line are staggered in vertical direction. A row of central holes are provided from the upper edge to the lower edge of the perforated plate 131 along the vertical central line, such row of central holes are comprised of 9 central holes 1312, with each central hole 1312 is a square hole. In this unlimited embodiment, the side length of the square hole approximately is set to the width of the rectangular hole.

Figure 4:
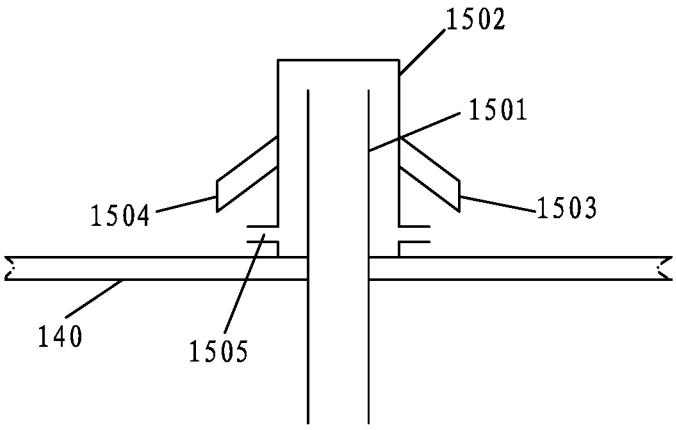
FIG. 4 is a structural illustration of an air cap according to the present invention.

Several air outlet ports (not labeled) are arranged on the top wall 1321 of the distributing chamber 132 in array, with each air outlet port connecting to each air cap 150 of the airflow distributing plate 140 through air inlet duct 700. As shown in FIG. 4, each air cap 150 is comprised of an inner duct 1501, an outer duct 1502 that is nested out the inner duct 1501, and two air outlet ducts 1503 and 1504 that are spaced extending downwards from the side wall of the outer duct 1502 and connecting to the internal portion of the outer duct 1502. The inner duct 1501 extends upwards from the upper surface of the airflow distributing plate 140 about each air inlet port (not shown) on the airflow distributing plate 140. The downside of the outer duct 1502 is connected to the upper surface of the airflow distributing plate 140, the upside of the outer duct 1502 is closed and the upper wall thereof is located above the upside of the inner duct 1501. Wherein, six same sized air holes 1505 are equidistantly arranged on the duct wall of the outer duct 1502 below the air outlet ducts 1503 and 1504. The distance between the terminal ends of the air outlet ducts 1503 and 1504 and the upper surface of the airflow distributing plate 140 is set to one fourth of the whole length of the inner duct 1501. The distance between the upside of the inner duct 1501 and the top wall of the outer duct 1502 is set to one sixth of the entire length of the inner duct 1501. The diameter of the outer duct 1502 is twice as much as that of the inner duct 1501.

As one of the alternative embodiments, an upper water collecting pipe 133 is arranged at the top connection area of the distributing chamber 132 and the air inlet chamber 135 of the air chamber 130, and a lower water collecting pipe 134 is arrange at the bottom connection area of the distributing chamber 132 and the air inlet chamber 135. The upper water collecting pipe 133 and the lower water collecting pipe 134 extend through the air chamber 130 along the horizontal direction (perpendicular to the paper direction in FIG. 2) of the air chamber 130. Two first clamping plates 1311 which are used to nest the upper edge of the perforated plate 131 extend downwards along the pipe wall of the upper water collecting pipe 133, and two second clamping plates 1341 which are used to nest the lower edge of the perforated plate 131 extend upwards along the pipe wall of the lower water collecting pipe 134.

As another alternative embodiment, an airflow guiding device 137 is provided in the middle of the bottom wall 1352 of the air inlet chamber 135. The airflow guiding device 137 comprises a first airflow guiding surface 1371 and a second airflow guiding surface 1372. The bottom edge of the first airflow guiding surface 1371 is connected to the bottom wall 1352 and the first airflow guiding surface 1371 extends upwards and backwards from the bottom edge. The second airflow guiding surface 1372 is an arc surface that extends upwards and forwards from the bottom edge, the chord of such arc surface is inclined with the bottom wall 1352 of the aim inlet chamber 135 at an angle of 45 degree. The top edge of the first airflow guiding surface 1371 is connected to the top edge of the second airflow guiding surface 1372 smoothly. The vertical distance between the top edge of the first airflow guiding surface 1371 (that is the connection area of the first airflow guiding surface and the second airflow guiding surface) and the bottom wall 1351 of the air inlet chamber 135 is 0.25 H, the horizontal distance between the top edge of the first airflow guiding surface 1371 and the bottom edge of the first airflow guiding surface 1371 is 0.5 H, and the horizontal distance between the top edge of the second airflow guiding surface 1372 and the bottom edge of the second airflow guiding surface is 0.25 H.

As shown in FIG. 1, as a further alternative embodiment, the circular fluidizing bed combustion system with uniform airflow distributing device further comprises a flue gas separation device 200 and a heat pipe heat exchanger 300 arranged along the flow direction of flue gas in the flue gas channel GL.

The flue gas separation device 200 comprises a separator body 210, a high temperature flue gas inlet 220, a lower exhaust tube 230, and a feedback outlet 240. The high temperature flue gas inlet 220 is provided on the side wall of the separator body 210 and connected to the flue gas channel GL. The lower exhaust tube 230 is perpendicular to the inner cavity of the separator body 210. The top inlet of the lower exhaust tube 230 is provided far away from the top wall of the separator body 210 and its bottom outlet is connected to the heat tube heat exchanger 300 through the flue gas channel GL. The feedback outlet 240 is provided on the bottom of the separator body 210 and connected to the fluidizing chamber 120 through a feedback pipe FL. The bottom portion of the separator body 210 is formed into a tapered portion, and the feedback outlet 240 is formed on the side wall of the tapered portion.

The heat pipe heat exchanger 300 comprises a housing (not labeled), a middle partition (not shown) and several heat pipes (not shown) that are arranged through the middle partition. The middle partition divides the inner space of the housing into a flue gas flow path (not shown) and an air flow path (not shown) that are parallel with each other in reverse. The evaporating end of the heat pipe extends in the flue gas flow path, and the condensing end of the heat pipe extends in the air flow path. The two ends of the flue gas flow path are formed into a cleaning flue gas flue gas inlet 310 and a low temperature flue gas outlet 330, and the two ends of the air flow path are formed into a cold air inlet 350 and a hot air outlet 370. The cleaning flue gas flue gas inlet 310 is connected to the bottom outlet of the lower exhaust tube 230 through the flue gas channel GL, to direct the high temperature flue gas into the flue gas flow path, in order to heat the cold air from the fluid flow path into hot air. The low temperature flue gas outlet 330 is connected to a chimney (not shown) through the flue gas channel GL. The cold air inlet 350 is connected to a first fan F1 through a cold air piping (not labeled), and the hot air outlet 370 is connected to the air chamber 130 directly through a hot air pipe.

As a further alternative embodiment, the flue gas channel GL branches into a back-flow flue gas pipe RL between the flue gas separation device 200 and the heat pipe heat exchanger 300. The back-flow flue gas pipe RL is connected to the hot air pipe HL and a mixer 400 is provided at the connection area thereof to mix a portion of the hot flue gas from the flue gas separation device 200 and the hot air from the heat pipe heat exchanger 300 into gas mixtures. The back-flow flue gas pipe returns about 15% of the total flue gas to the mixer 400 in order to mix it with the hot air.

The mixer 400 comprises a mixer body, a hot air inlet 410 that is provided at one end of the mixer body, a hot flue gas inlet 430 that is provided at one side of the mixer body, a gas mixing cavity (not labeled) that is provided in the inner space of the mixer body, and a gas mixtures outlet 450 that is provided at the other end of the mixer body. The hot air inlet 410 of the mixer 400 is connected to the hot air outlet 370 of the heat pipe heat exchanger 300 through the hot air pipe HL, the hot flue gas inlet 430 of the mixer 400 is connected to the back-flow flue gas pipe RL, and the gas mixtures outlet 450 of the mixer 400 is connected to the air inlet port 13511 of the air inlet chamber 135 of the air chamber 130 through a gas mixtures pipe (not labeled). Rotating impellers (not shown) are provided in the gas mixing cavity adjacent to the gas mixtures outlet.

A first valve V1 is provided on the back-flow flue gas pipe RL adjacent to the mixer 400 for adjusting the flow of the back-flow flue gas. A second valve V2 is provided on the hot air pipe HL adjacent to the mixer 400 for adjusting the flow of the hot air.

As a further alternative embodiment, the circular fluidizing bed combustion system with uniform airflow distributing device also comprises a screw feeder 900 that is connected to the coal powder inlet 118 on the side wall (not labeled) of the fluidizing chamber 120, in order to deliver the coal powder into the fluidizing chamber 120 for fluidizing combustion.

As such, after entering into the air inlet chamber 135 through the air inlet port 13511 of the air inlet chamber 135 and being guided by the airflow shield 1356 and the airflow guiding device 137, the fluidizing air (the gas mixtures from the mixer 400 or the air directly from the fan) enters into the distributing chamber 132 through the perforated plate 131 and enters into the air cap 150 through the air inlet duct 700 after distributed uniformly in the distributing chamber 132 by the first guide plate 601, the second guide plate 602 and the third guide plate 603. A portion of the fluidizing air from the air cap 150 is injected to the upper surface of the airflow distributing plate 140 through the air outlet ducts 1503 and 1504, and the other portion is injected into the fluidizing bed 120 through the six air holes 1505, in order to fluidized combust the coal powder delivered into the fluidizing chamber 120 through the coal powder inlet 118 by the screw feeder 900.

Although the preferred embodiments of the present invention have been described in detail herein, it is understood that the present invention is not limited to the detailed description and the illustrative specific structures. The skilled in the art will be able to implement other variations and amendments thereof without departing from the nature and scope of the present invention. Furthermore, the parameters such as temperature and ratio throughout the system should be properly selected based on the particular operating conditions in the disclosed scope of the present invention.

The invention claimed is:

1. A circular fluidizing bed combustion system with uniform airflow distributing device, comprising:

a fluidizing bed that is comprised of a fluidizing bed boiler body, an airflow distributing plate that is provided inside the fluidizing bed boiler body and divides the inner space of the fluidizing bed boiler body into a fluidizing chamber which is located in the upper portion of the boiler body and an air chamber which is located in the lower portion of the boiler body, and a plurality of air caps that are arranged on the airflow distributing plate for injecting the fluidizing air into the fluidizing chamber; and a flue gas channel that is connected to the sidewall of the fluidizing bed boiler body, so as to exhaust the flue gas generated from fuel combustion in the fluidizing chamber;

wherein, the inner space of the air chamber is divided into a distributing chamber that is located under the airflow distributing plate and an air inlet chamber that is located on one side of the distributing chamber by means of a perforated plate, the distributing chamber is comprised of a front wall, two side walls, and a top wall that extends upwards obliquely from the upside of the front wall, and a bottom wall that extends downwards obliquely from the downside of the front wall, a vertical distance H is defined between a first planar surface that passes through the extension end of the top wall and is parallel with the airflow distributing plate and a second planar surface that passes through the extension end of the bottom wall and is parallel with the airflow distributing plate, the perforated plate lies in the surface that passes through the extension ends of both top wall and bottom wall and is perpendicular with the first and second planar surfaces, a horizontal distance W is defined between the front wall of the distributing chamber and the perforated plate, at least a first guide plate and a second guide plate are installed in the distributing chamber, with the two side edges of the first guide plate and the second guide plate fixed to the two side walls of the distributing chamber respectively, the vertical distance between the bottom edge of the first guide plate and the first planar surface is 0.3-0.4H, the horizontal distance between the bottom edge of the first guide plate and the perforated plate is 0.2-0.3W, the first guide plate extends upwards and forwards by a distance of 0.1-0.2H at an angle of 70-80 degree from the bottom edge with respect to the second planar surface, the vertical distance between the bottom edge of the second guide plate and the first planar surface is 0.4-0.5H, the horizontal distance between the bottom edge of the second guide plate and the perforated plate is 0.4-0.6W, the second guide plate extends upwards and forwards by a distance of 0.13-0.18H at an angle of 75-85 degree from the bottom edge with respect to the second planar surface, wherein W:H is set to 1-1.5:1.

2. The circular fluidizing bed combustion system with uniform airflow distributing device according to claim 1, wherein a third guide plate is further installed in the distributing chamber, the third guide plate is comprised of a straight guide plate and an arched guide plate that extends downwards and backwards from the bottom edge of the straight guide plate, the vertical distance between the bottom edge of the straight guide plate and the first planar surface is 0.6-0.7H, the horizontal distance between the bottom edge of the straight guide plate and the perforated plate is 0.7-0.8W, the straight guide plate extends upwards and forwards by a distance of 0.15-0.2H at an angle of 70-80 degree from the bottom edge with respect to the second planar surface, the arched guide plate is with a central angle of 80-100 degree and a radius of 0.05-0.1H.

3. The circular fluidizing bed combustion system with uniform airflow distributing device according to claim 2, wherein several rows of rectangular holes are formed on the perforated plate along longitudinal direction from one side edge to the other, with each row of the rectangular holes comprised of several rectangular holes that are arranged sequentially from the upper edge to the lower edge of the perforated plate in vertical direction.

4. The circular fluidizing bed combustion system with uniform airflow distributing device according to claim 3, wherein the long side of each rectangular hole is provided along the longitudinal direction of the perforated plate, the short side of each rectangular hole is provided in the vertical direction along the perforated plate, the length-width ratio for each rectangular hole is set to 3-5:1, and the several rows of rectangular holes are symmetrically arranged with respect to the vertical central line of the perforated plate.

5. The circular fluidizing bed combustion system with uniform airflow distributing device according to claim 4, wherein two adjacent rows of rectangular holes situated on the same side with respect to the vertical central line of the perforated plate are staggered in vertical direction, each row of the rectangular holes comprises at least 8 rectangular holes, a row of central holes are provided from the upper edge to the lower edge on the perforated plate along the vertical central line, the row of central holes comprise at least 8 central holes, with each central hole being a circular or square hole.

6. The circular fluidizing bed combustion system with uniform airflow distributing device according to claim 5, wherein the air inlet chamber of the air chamber is comprised of a top wall, a bottom wall, a back wall and two side walls, the top wall of the air inlet chamber is connected to the top wall of the distributing chamber, and the bottom wall of the air inlet chamber is connected to the bottom wall of the distributing chamber, the two side walls of the air inlet chamber are connected to the two side walls of the distributing chamber respectively, the back wall of the air inlet chamber and the front wall of the distributing chamber are provided opposing to each other in longitudinal direction of the air chamber, an air inlet port is provided on the top wall of the air inlet chamber adjacent to the back wall, an airflow shield is formed by the forward extension of the lower portion of the back wall, with the bottom edge of the airflow shield connected to the bottom wall of the air inlet chamber.

7. The circular fluidizing bed combustion system with uniform airflow distributing device according to claim 6, wherein an airflow guiding device is provided on the bottom wall of the air inlet chamber, the airflow guiding device comprises a first airflow guiding surface and a second airflow guiding surface, and the bottom edge of the first airflow guiding surface is connected to the bottom wall and the first airflow guiding surface extends upwards and backwards from the bottom edge, the bottom edge of the second airflow guiding surface is connected to the bottom wall and the second airflow guiding surface extends upwards and forwards from the bottom edge, the top edge of the first airflow guiding surface is connected to the top edge of the second airflow guiding surface.

8. The circular fluidizing bed combustion system with uniform airflow distributing device according to claim 7, wherein the second airflow guiding surface is an arc surface that extends upwards and forwards from the bottom edge, the chord of the arc surface is inclined with respect to the bottom wall of the air inlet chamber at an angle of 30-50 degree, the vertical distance between the top edge of the first airflow guiding surface and the bottom wall of the air inlet chamber is 0.2-0.3H, and the horizontal distance between the top edge of the first airflow guiding surface and the bottom edge of the first airflow guiding surface is 0.4-0.6H, and the horizontal distance between the top edge of the second airflow guiding surface and the bottom edge of the second airflow guiding surface is 0.2-0.3H.

9. The circular fluidizing bed combustion system with uniform airflow distributing device according to claim 8, wherein an upper water collecting pipe is arranged at the top connection area between the distributing chamber and the air inlet chamber of the air chamber, and a lower water collecting pipe is arranged at the bottom connection area between the distributing chamber and the air inlet chamber, two first clamping plates which are used to nest the upper edge of the perforated plate extend downwards along the pipe wall of the upper water collecting pipe, and two second clamping plates which are used to nest the lower edge of the perforated plate extend upwards along the pipe wall of the lower water collecting pipe.

10. The circular fluidizing bed combustion system with uniform airflow distributing device according to claim 9, wherein a plurality of air outlet ports are arranged on the top wall of the distributing chamber in array, with each air outlet port connecting to each air cap of the airflow distributing plate by means of an air inlet duct, in order to direct the air from the distributing chamber into the fluidizing bed through the air inlet duct, each air cap comprises an inner duct, an outer duct that is nested out the inner duct, and at least two air outlet ducts that obliquely extend downwards at intervals from the side wall of the outer duct and connect to the internal portion of the outer duct, the inner duct extends upwards from the upper surface of the airflow distributing plate around each air inlet portion on the airflow distributing plate, the downside of the outer duct is connected to the upper surface of the airflow distributing plate, the upside of the outer duct is closed and the upper wall thereof is located above the upside of the inner duct, wherein at least six air holes are arranged on the duct wall of the outer duct below the at least two air outlet ducts, so that after the fluidizing air from the air chamber has passed the upside of the inner duct into the space between the outer wall of the inner duct and the inner wall of the outer wall through the air inlet port, a portion of the fluidizing air is injected to the upper surface of the airflow distributing plate through the at least two air outlet ducts, and the other portion of the fluidizing air is injected into the fluidizing bed through the at least six air holes.

* * * * *